United States Patent [19]

Higashiyama

[11] Patent Number: 4,690,124

[45] Date of Patent: Sep. 1, 1987

[54] SPARK CONTROL SYSTEM FOR AN ENGINE

[75] Inventor: Kazuhiro Higashiyama, Ebina, Japan

[73] Assignee: Nissan Motor Company Limited, Yokohama, Japan

[21] Appl. No.: 861,006

[22] Filed: May 8, 1986

[30] Foreign Application Priority Data

Jun. 5, 1985 [JP] Japan ..... 60-120397

[51] Int. Cl.[4] ..... F02P 23/00

[52] U.S. Cl. ..... 123/643; 123/179 BG; 123/179 B

[58] Field of Search ..... 123/643, 406, 417, 418, 123/179 BG, 179 B, 425, 339, 422

[56] References Cited

U.S. PATENT DOCUMENTS

| | | | |
|---|---|---|---|
| 4,457,286 | 6/1984 | Kotayama et al. | 123/643 |
| 4,478,201 | 10/1984 | Asik | 123/643 |
| 4,485,784 | 12/1984 | Fujii et al. | 123/643 |
| 4,493,306 | 1/1985 | Asik | 123/643 |
| 4,515,131 | 5/1985 | Suzuki et al. | 123/643 |
| 4,553,517 | 11/1985 | Andreassen | 123/418 |

*Primary Examiner*—Raymond A. Nelli

*Attorney, Agent, or Firm*—Schwartz, Jeffery, Schwaab, Mack, Blumenthal & Evans

[57] ABSTRACT

An engine has a crankshaft and cylinders. Each of the cylinders is associated with an ignition coil and a power transistor for controlling the ignition coil. Reference signals are generated at reference crank angles corresponding to the cylinders respectively. The cylinders are separated into groups and the cylinders in a common group are different from each other by an interval of 360° in crank angle. The reference signals corresponding to the cylinders in a common group are similar to each other. The reference signal corresponding to the cylinder in a group is different from the reference signal corresponding to the cylinder in other group. The reference signal corresponding to preset one of the cylinders is different from the reference signals corresponding to the other cylinders. During engine start, sparks are caused simultaneously in the cylinders in a common group in accordance with the reference signals corresponding to said cylinders in said group until the reference signal corresponding to the preset cylinder is generated. When and after the reference signal corresponding to the preset cylinder is generated, a spark is caused in one of the cylinders sequentially in a predetermined order starting from the preset cylinder.

3 Claims, 11 Drawing Figures

POS
2°
PA
PB
PC
PD
REF

CYLINDER DISCRIMINATION CIRCUIT
REF
POS
301
MONO MULTI
302
MONO MULTI
303
COUNTER
304
COUNTER
305
AND
R
C
PW
306
COMPARATOR
307
COMPARATOR
308
COMPARATOR
309
DECODER
310
F/F
S
R
SA
SB
SC
SD
SE
311
AND
312
AND
313
AND
314
AND

FIG. 6

| | PD | PC | PB | PA |
|---|---|---|---|---|
| OUTPUT OF COMPARATOR 306 | L | H | H | H |
| OUTPUT OF COMPARATOR 307 | L | L | H | H |
| OUTPUT OF COMPARATOR 308 | L | L | L | H |
| $S_A$ | L | L | L | H |
| $S_B$ | L | L | H | L |
| $S_C$ | L | H | L | L |
| $S_D$ | H | L | L | L |

FIG. 8

| | | | | |
|---|---|---|---|---|
| $S_A$ | H | L | L | L |
| $S_B$ | L | H | L | L |
| $S_C$ | L | L | H | L |
| $S_D$ | L | L | L | H |
| $S_1$ | L | L | H | H |
| $S_2$ | H | H | H | L |
| $S_3$ | H | H | L | H |
| $S_4$ | H | L | H | H |
| $S_5$ | H | H | H | L |
| $S_6$ | H | H | L | H |

DISTRIBUTION CIRCUIT
REGISTER
LOAD
CLK
DECODER
PULSE GENERATOR
Sign
OR
AND
F/F
S#1
S#5
S#3
S#6
S#2
S#4
$S_A$
$S_B$
$S_C$
$S_D$

FIG. 9

| REFERENCE PULSE | IGNITED CYLINDER | | OPERATED POWER TRANSISTOR | |
|---|---|---|---|---|
| | NORMAL | INITIAL | NORMAL | INITIAL |
| PA | #1 | #1 | 211 | 211 |
| PD | #5 | #5, #2 | 212 | 212, 215 |
| PC | #3 | #3, #4 | 213 | 213, 216 |
| PB | #6 | #6, #1 | 214 | 214, 211 |
| PD | #2 | #2, #5 | 215 | 215, 212 |
| PC | #4 | #4, #3 | 216 | 216, 213 |

FIG. 10

| | | | | |
|---|---|---|---|---|
| $S_A$ | H | L | L | L |
| $S_B$ | L | H | L | L |
| $S_C$ | L | L | H | L |
| $S_D$ | L | L | L | H |
| $S_1$ | L | H | H | H |
| $S_2$ | H | H | H | L |
| $S_3$ | H | H | L | H |
| $S_4$ | H | L | H | H |
| $S_5$ | H | H | H | L |
| $S_6$ | H | H | L | H |

FIG. 11

| REFERENCE PULSE | IGNITED CYLINDER | | OPERATED POWER TRANSISTOR | |
|---|---|---|---|---|
| | NORMAL | INITIAL | NORMAL | INITIAL |
| PA | #1 | #1 | 211 | 211 |
| PD | #5 | #5, #2 | 212 | 212, 215 |
| PC | #3 | #3, #4 | 213 | 213, 216 |
| PB | #6 | #6 | 214 | 214 |
| PD | #2 | #2, #5 | 215 | 215, 212 |
| PC | #4 | #4, #3 | 216 | 216, 213 |

SPARK CONTROL SYSTEM FOR AN ENGINE

BACKGROUND OF THE INVENTION

This invention relates to a spark control system for an engine.

Conventional engine spark control systems generally include an ignition coil generating high potential pulses and a distributor which acts to distribute the high potential pulses to spark plungs sequentially.

Some advanced spark control systems generally called direct ignition systems do not have such a high potential distributor so that they are advantageous in maintenance free and reliability. In these systems, ignition coils are directly coupled to spark plungs respectively. These systems include a device to detect or discriminate which engine cylinder should be currently exposed to spark. In accordance with a signal from this cylinder discrimination device, the ignition coil corresponding to the cylinder needing spark is activated.

The cylinder discrimination device has a crank angle sensor including a signal disc rotatable together with the engine camshaft. In the case of a six-cylinder engine, the signal disc has angularly spaced six slits corresponding to the cylinders. As the signal disc rotates, the slits periodically unblock a fixed optical path. These periodical unblockages of the optical path is detected and converted into electrical pulses corresponding to the engine cylinders. One slit differs from others which are identical. This unique slit corresponds to a single reference cylinder and causes a particular pulse different from other pulses. the reference cylinder is discriminated by receiving a particular pulse. The other cylinders are discriminated by counting the pulses after the receipt of a particular pulse.

It is assumed that immediately after the unique slit passes the optical path, the signal disc stops as a result of halt of the engine. During re-start of this engine, it is difficult to discriminate the engine cylinders for an initial interval approximately corresponding to first two revolutions of the engine crankshaft.

SUMMARY OF THE INVENTION

It is an object of this invention to provide a spark control system for an engine which can reliably cause sparks in cylinders currently needing spark when the engine is cranked or started.

In accordance with this invention, a spark control system is designed for use with an engine having a crank shaft and cylinders. Each of the cylinders is associated with an ignition coil and a power transistor for controlling the ignition coil. Reference signals are generated at reference crank angles corresponding to the cylinders respectively. The cylinders are separated into groups and the cylinders in a common group are different from each other by an interval of 360° in crank angle. The reference signals corresponding to the cylinders in a common group are similar to each other. The reference signal corresponding to the cylinder in a group is different from the reference signal corresponding to the cylinder in other group. The reference signal corresponding to preset one of the cylinders is different from the reference signals corresponding to the other cylinders. During engine start, sparks are caused simultaneously in the cylinders in a common group in accordance with the reference signals corresponding to said cylinders in said group until the reference signal corresponding to the preset cylinder is generated. When and after the reference signal corresponding to the preset cylinder is generated, a spark is caused in one of the cylinders sequentially in a predetermined order starting from the preset cylinder.

BRIEF DESCRIPTION OF THE DRAWINGS

FIG. 6 is a table indicating the relationship between states of input signals into the decoder and states of output signals from the decoder of FIG. 5.

FIG. 8 is a table indicating the relationship between states of input signals into the decoder and states of output signals from the decoder of FIG. 7.

FIG. 9 is a table indicating the relationship between the reference signal from the crank angle sensor and the operated power transistor and also the relationship between the reference signal and the engine cylinder subjected to spark.

FIG. 10 is a table corresponding to that of FIG. 8 and indicates the relationship between states of input signals into a modified decoder and states of output signals from the modified decoder.

FIG. 11 is a table corresponding to that of FIG. 9 and indicates the relationship between the reference signal from the crank angle sensor and the operated power transistor and also the relationship between the reference signal and the engine cylinder subjected to spark in the case where the modified decoder related to FIG. 10 is used.

DESCRIPTION OF THE PREFERRED EMBODIMENTS

Figure 1:
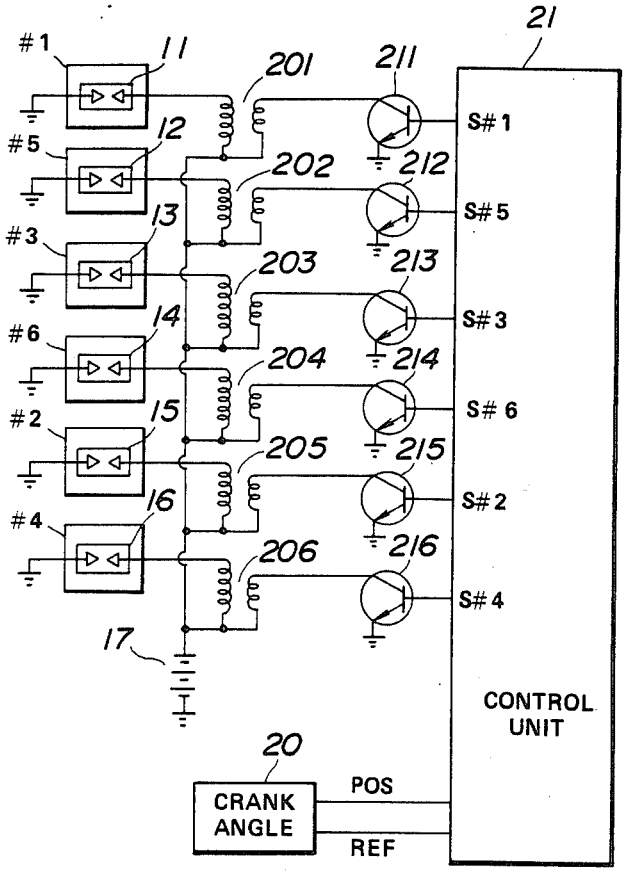
FIG. 1 is a diagram of a spark control system according to an embodiment of this invention.

With reference to FIG. 1, an engine has six cylinders #1, #2, #3, #4, #5 and #6 provided with spark plugs 11, 15, 13, 16, 12 and 14, respectively. It should be noted that the spark order of the cylinders is as follows: #1, #5, #3, #6, #2, and #4. The secondary windings of ignition coils 201–206 are respectively connected across the spark plungs 11–16 via a common DC power source 17. The primary windings of the ignition coils 201–206 are respectively connected across the emitter-collector pathes of power transistors 211–216 via the DC power source 17. Switchings of the power transistors 211–216 cause the corresponding ignition coils 201–206 to generate high potentials across the spark plugs 11–16 which result in sparks in the associated cylinders #1–#6.

A control unit 21 outputs spark control signals S#1, S#2, S#3, S#4, S#5, and S#6 to the bases of the power transistors 211, 215, 213, 216, 212, 214 respectively. When these signals S#1–S#6 make the power transistors 211–216 unconductive, the associated ignition coils 201–206 are activated so that sparks are created in the cylinders #1–#6 by the plugs 11–16.

A crank angle sensor 20 generates a position pulse POS each time the engine crankshaft rotates through 2°. Also, the crank angle sensor 20 generates a reference pulse REF each time the crankshaft rotates through 120°. The leading edges of the reference pulses REF occur at crank angles 110° prior to the top dead centers of the cylinders on the compression stroke.

The position pulses POS are applied to the control unit 21. On the basis of these pulses POS, the control unit 21 conventionally detects the current angular position of the crankshaft, that is, the crank angle. The position pulses POS are also used in discriminating the reference pulses REF as will be described hereinafter.

The reference pulses REF are applied to the control unit 21. On the basis of these pulses REF, the control unit 21 detects or discriminates which cylinder currently needs spark. As will be made clear hereinafter, during an initial stage of engine start, the control unit 21 applies the spark causing signal to the power transistor which is associated with the detected or discriminated cylinder.

Figure 2:
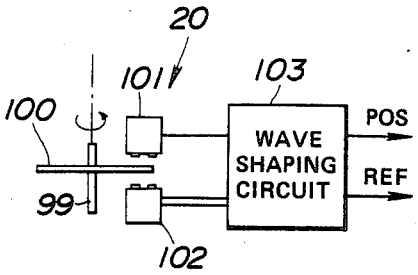
FIG. 2 is a diagrammatical view of the crank angle sensor of FIG. 1.

As shown in FIG. 2, the crank angle sensor 20 includes a shaft 99 and a signal disc 100 coaxially fixed to the shaft 99. Since the shaft 99 is connected to the engine camshaft, the signal disc 100 rotates together with the camshaft. The signal disc 100 extends between a light transmitter 101 and a light receiver 102. The transmitter 101 includes light-emitting diodes which continuously generate light. The receiver 102 includes photodiodes. The photodiodes can be optically coupled to the light-emitting diodes via two light paths. These optical paths can be periodically blocked and unblocked by the signal plate 100 as will be made clear hereinafter. When the optical paths are unblocked, the photodiodes receive light from the light-emitting diodes. When the optical paths are blocked, the photodiodes do not receive light from the light-emitting diodes. Accordingly, the photodiodes generate signals reflecting blockage and unblockage of the optical paths.

Figure 3:
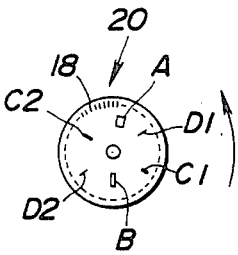
FIG. 3 is a plan view of the signal disc in the crank angle sensor of FIG. 2.

As shown in FIG. 3, the signal disc 20 has identical slits 18 for the position signal POS which are angularly spaced along a first circumference. One optical path passes this circumference so that it is periodically unblocked by the slits 18 during rotation of the signal disc 100. It should be noted that this optical path is blocked by the signal disc 100 between the slits 18. The signal disc 20 also has slits A, B, C1, C2, D1, and D2 for the reference signal REF which are angularly spaced along a second circumference. The other optical path passes this circumference so that is is periodically unblocked by the slits A, B, C1, C2, D1, and D2 during rotation of the signal disc 100. It should be noted that this optical path is blocked by the signal disc 100 between the slits A, B, C1, C2, D1, and D2.

The slit A diametrically opposes the slit B. The slit C1 diametrically opposes the slit C2. The slit D1 diametrically opposes the slit D2. These slits are arranged in the following order along the direction of rotation of the signal disc 100 as viewed in FIG. 3: A, C2, D2, B, C1, and D1.

The circumferential dimensions of the slits A, B, C1, C2, D1 and D2 belong to four different values. The circumferential dimension of the slit A is a first value. The circumferential dimension of the slit B is a second value. The slits C1 and C2 have the same circumferential dimension equal to a third value. The slits D1 and D2 have the same circumferential dimension equal to a fourth value.

Specifically, the circumferential dimension of the slit A corresponds to a crank angle interval of 14°. The circumferential dimension of the slit B corresponds to a crank angle interval of 10°. The circumferential dimension of the slits C1 and C2 corresponds to a crank angle interval of 6°. The circumferential dimension of the slits D1 and D2 corresponds to a crank angle interval of 2°.

As shown in FIG. 2, a wave shaping circuit 103 receives the signals from the light receiver 102. The wave shaping circuit 103 derives the position signal POS and the reference signal REF from the signals outputted by the light receiver 102.

The wave shaping circuit 103 may include comparators which drive the signals POS and REF by comparing the signals from the light receiver 102 with reference voltages.

Figure 4:
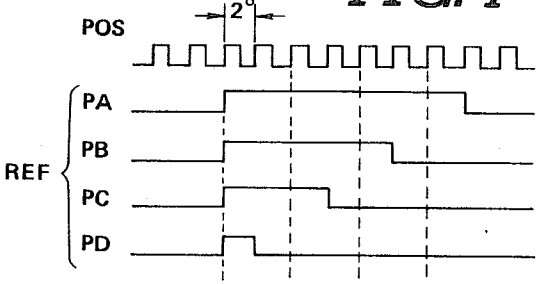
FIG. 4 are waveforms of the output signals from the crank angle sensor of FIGS. 1 and 2.

As shown in FIG. 4, the position signal POS contains pulses spaced at equal crank angle intervals of 2°. The reference signal REF contains pulses PA, PB, PC, and PD having leading edges which are spaced at equal crank angle intervals of 120°. The pulse PA is caused by the slit A in the signal disc 100 so that the duraction or width of the pulse PA corresponds to a crank angle interval of 14°. The pulse PB is caused by the slit B in the signal disc 100 so that the duration or width of the pulse PB corresponds to a crank angle interval of 10°. The pulse PC is caused by the slits C1 and C2 in the signal disc 100 so that the duration or width of the pulse PC corresponds to a crank angle interval of 6°. The pulse PD is caused by the slits D1 and D2 in the signal disc 100 so that the duration or width of the pulse PB corresponds to a crank angle interval of 2°. These pulses are cyclically outputted in the following order: PA, PD, PC, PB, PD, and PC.

Figure 5:
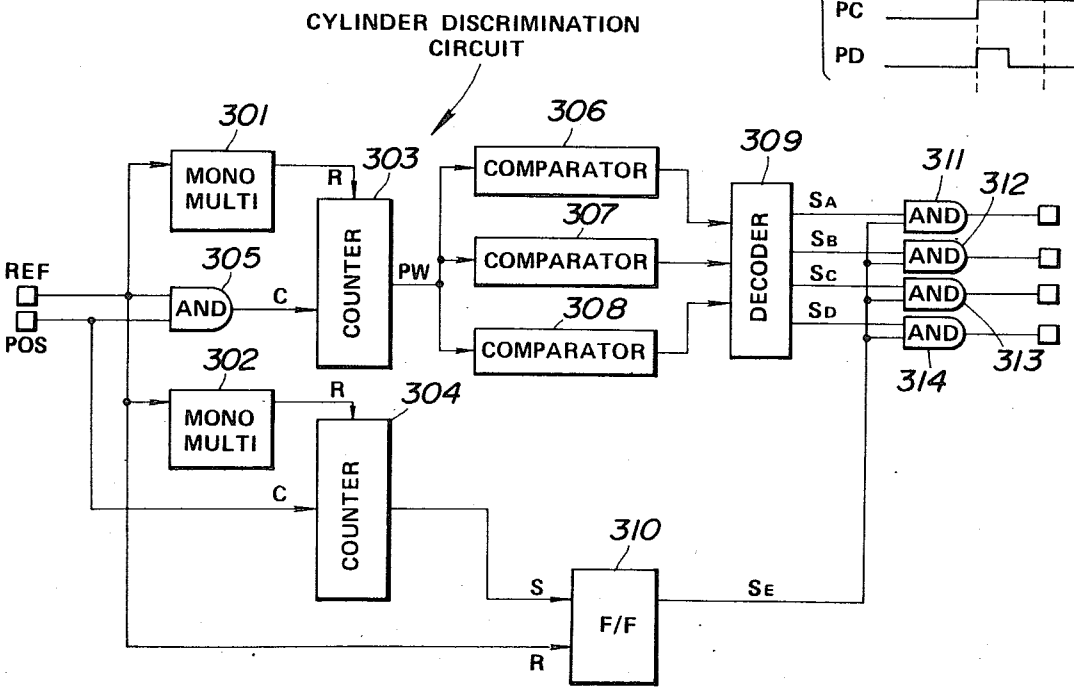
FIG. 5 is a block diagram of a cylinder discrimination circuit in the control unit of FIG. 1.

The control unit 21 includes a cylinder discrimination circuit. As shown in FIG. 5, the discrimination circuit includes monostable multivibrators 301 and 302 triggered by the leading edges of the reference pulses REF. The monostable multivobrators 301 and 302 output pulses which reset binary counters 303 and 304 respectively at a moment concurrent with the leading edges of the reference pulses REF. An AND gate 305 passes the position pulses POS to the clock input terminal of the counter 303 while the reference signal REF ramains at the high level. Accordingly, the counter 303 detects the width or duration of the reference pulse REF and generates a signal PW indicative thereof in unit of a crank angle interval of 2°.

The output signal PW from the counter 303 is applied to comparators 306, 307, and 308 so that the reference pulse REF can be discriminated. The circuit 306 compares the counted number PW with a preset number equal to 2. The circuit 307 compares the counted number OW with a preset number equal to 4. The circuit 308 compares the counted number PW with a preset number equal to 6. The output signals from the comparators 306–308 are applied to a decoder 309. The engine cylinder needing spark is discriminated by the decoder 309 on the basis of the output signals from the comparators 306–308. The decoder 309 generates cylinder discrimination signals SA, SB, SC, and SD in accordance with the output signals from the comparators 306–308.

As shown in FIG. 6 where "L" and "H" indicate a low level state and a high level state respectively, in the case of a reference pulse PA, the output signals from the comparators 306–308 are all at the high level and only the cylinder discrimination signal SA is at the high level. In the case of a reference pulse PB, the output signals from the comparators 306 and 307 are at the high level but the output signal from the comparator 308 is at the low level, and only the cylinder discrimination signal SB is at the high level. In the case of a reference pulse PC, the output signal from the comparator 306 is at the high level but the output signals from the comparators 307 and 308 are at the low level, and only the cylinder discrimination signal SC is at the high level. In the case of a reference pulse PD, the output signals from the comparators 306–308 are all at the low level and only the cylinder discrimination signal SD is at the high level. The cylinder discrimination signals SA–SD represents the engine cylinder needing spark.

The position pulses POS are applied to the clock input terminal of the counter 304. The counter 304 starts to count the position pulses POS at a moment concurrent with the leading edge of a reference pulse REF. When the counted number reaches eight, the counter 304 outputs a pulse to the set terminal of a flip-flop (F/F) 310 so that the circuit 310 is set. The flip-flop 310 is reset by the leading edges of the reference pulses REF. Accordingly, the output signal SE from the flip-flop 310 represents whether or not the circuits 301, 303, 305, 306, 307, 308, and 309 are currently in cylinder discrimination operation. Specifically, the signal SE remains at the low level during the cylinder discrimination process and at the high level otherwise.

First input terminals of AND gates 311–314 receive the signal SE. Second input terminals of the gates 311–314 receive the cylinder discrimination signals SA–SD respectively. The gates 311–314 pass the signals SA–SD while the cylinder discrimination process is not being performed. The gates 311–314 interrupt the transmissions of the signals SA–SD during the cylinder discrimination process.

Figure 7:
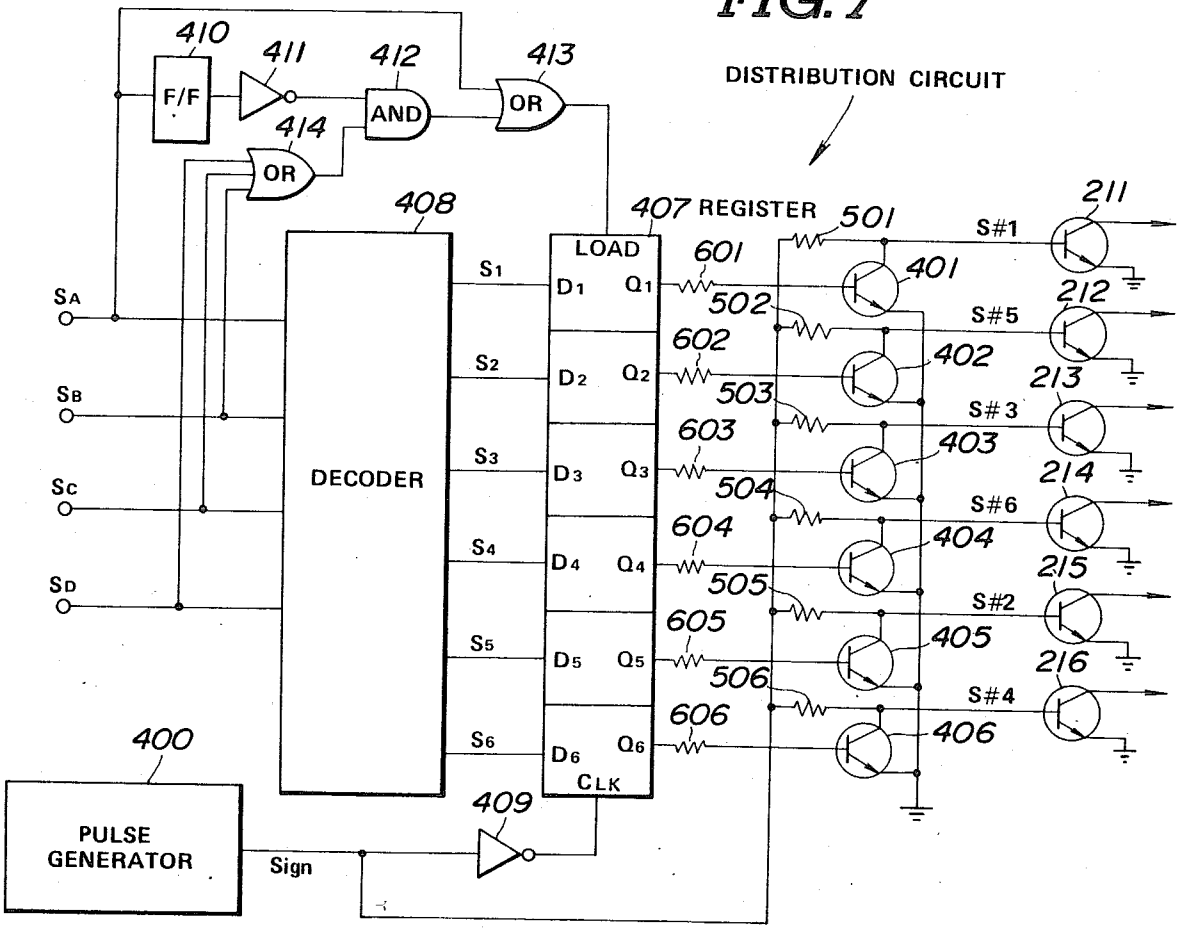
FIG. 7 is a diagram of a distribution circuit in the control unit of FIG. 1.

The control unit 21 includes a distribution circuit. As shown in FIG. 7, the distribution circuit includes a main section orpulse generator 400 which outputs a spark control signal Sign having a pulse train. Trailing edges of the spark control pulses Sign determine spark timings. Durations or widths of the spark control pulses sign determine dwell angles of the ignition coils 201–206. The spark timing and the dwell angle are basically adjusted in accordance with engine operating conditions, such as engine speed and engine load, in a conventional way. The spark timing may be adjusted in accordance with engine knocking conditions in a known way.

The main section 400 may receive the reference pulses REF and the position pulses POS from the crank angle sensor 20. In this case, the main section 400 derives spark control pulses Sign from these pulses REF and POS in a known way. Specifically, the frequency of the spark control signal Sign is equal to that of the reference signal REF. The durations or widths of the spark control pulses Sign are adjusted in accordance with engine operating conditions detected by sensors. The main section 400 detects the current crank angle by counting the position pulses POS, or by counting 1° pulses derived from the position pulses POS, after the receipt of the leading edge of a reference pulse REF or a particular reference pulse PA. The detection of the current crank angle is used in setting or adjusting timings of the spark control pulses Sign. The durations of the spark control pulses are determined in unit of a position pulse POS or a 1° pulse derived from the position signal POS.

The spark control signals Sign can be applied to the bases of the power transistors 211–216 via resistors 501–506 respectively. Transistors 401–406 enable and interrupt the transmissions of the spark control signal Sign to the power transistors 211–216 respectively. The spark control signals Sign applied to the power transistors 211, 212, 213, 214, 215, and 216 are represented by the reference characters S#1, S#5, S#3, S#6, S#2, and S#4 respectively. The collector of thr transistor 401 is connected to the junction between the resistor 501 and the base of the power transistor 211. The emitter of the transistor 401 is grounded. The other transistors 402–406 are connected to the power transistors 212–216 respectively in a manner similar to the connection of the transistor 401 to the power transistor 211. The emitters of the transistors 402–406 are all grounded. When the transistors 401–406 are unconductive, the transmissions of the spark control signal Sign to the associated power transistors 211–216 are enabled respectively. When the transistors 401–406 are conductive, the transmissions of the spark control signal Sign to the associated power transistors 211–216 are interrupted respectively.

The parallel input terminals D1–D6 of a presetable shift register 407 receive output signals S1–S6 from a decoder 408 respectively. The output terminals Q1–Q6 of the register 407 are connected to the bases of the transistors 401–406 via resistors 601–606 respectively. The spark control signal Sign is transmitted via an invertor 409 to the shift timing control clock input terminal CLK of the register 407, so that the pattern of the output signals from the register 407 is shifted each time the trailing edge of a spark control pulse Sign occurs, that is, each time spark occurs.

The input terminals of the decoder 408 receive the cylinder discrimination signals SA–SD respectively. The decoder 408 generates the output signals S1–S6 in accordance with the cylinder discrimination signals SA–SD.

As shown in FIG. 8 where "L" and "H" indicate a low level state and a high level state respectively, when the signal SA is at the high level but the others SB–SC are at the low level, the signal S1 assumes the low level but the others S2–S6 assume the high level. When the signal SB is at the high level but the others SA, SC, and SD are at the low level, the signals S1 and S4 assume the high level. When the signal SC is at the high level but the others SA, SB, and SD are at the low level, the signals S3 and S6 assume the low level but the others S1, S2, S4, and S5 assume the high level. When the signal SD is at the high level but the others SA–SC are at the low level, the signals S2 and S5 assume the low level but the others S1, S3, S4, and S6 assume the high level.

The registor 407 has a load input terminal LOAD. Control of this load input terminal allows the register 407 to sample and hold the input signals S1–S6 which are transmitted to the output terminals Q1–Q6 respectively. The load input terminal of the register 407 receives a sample enabling pulse from a logic circuit including a flip-flop 410, an invertor 411, an AND gate 412, and OR gates 413 and 414. The flip-flop 410 is triggered by the cylinder discrimination pulse SA. The output signal from the flip-flop 410 is transmitted to a first input terminal of the AND gate 412 via the invertor 411. The other cylinder discrimination pulses SB–SD are applied to a second input terminal of the AND gate 412 via the OR gate 414. The output signal from the AND gate 412 is applied to the load input terminal of the register 407 via the OR gate 413. The cylinder discrimination pulse SA is also applied to the load input terminal of the register 407 via the OR gate 413. The operation of this logic circuit will be described in detail hereinafter.

As shown in FIG. 9, during engine cranking or start, specifically during an initial interval unitl the receipt of the first reference pulse PA, when the reference pulse PB is inputted into the control unit 21, the circuit 21 outputs the spark control signals S#1 and S#6 to the power transistors 211 and 214, causing sparks simultaneously in the associated cylinders #1 and #6. When the reference pulse PC is inputted into the control unit 21, the circuit 21 outputs the spark control signals S#3 and S#4 to the power transistors 213 and 216, causing sparks simultaneously in the associated cylinders #3 and #4. When the reference pulse PD is inputted into the control unit 21, the circuit 21 outputs the spark control signals S#2 and S#5 to the power transistors 212 and 215, causing sparks simultaneously in the associated cylinders #2 and #5.

Operation during the above-mentioned initial interval will be described in more detail. In the case where the reference pulse PB is inputted into the control unit 21, the cylinder discrimination circuit within the unit 21 generates the corresponding cylinder discrimination pulse SB as understood from FIG. 6. This cylinder discrimination pulse SB is transmitted to the decoder 408 so that only the output signals S1 and S4 assume the low level as understood from FIG. 8. At the same time, the cylinder discrimination pulse SB is transmitted to the load input terminal of the register 407 via the OR gates 413 and 414, and the AND gate 412, allowing the register 407 to sample and hold the input signals S1–S6. Since only the signals S1 and S4 are at the low level, only the transistors 401 and 404 are made unconductive. Accordingly, the spark control signals S#1 and S#6 are outputted to the power transistors 211 and 214 so that the associated cylinders #1 and #6 are exposed to sparks.

In the case where the reference pulse PC is inputted into the control unit 21, the cylinder discrimination circuit within the unit 21 generates the corresponding cylinder discrimination pulse SC as understood from FIG. 6. This cylinder discrimination pulse SC is transmitted to the decoder 408 so that only the output signals S3 and S6 assume the low level as understood from FIG. 8. At the same time, the cylinder discrimination pulse SC is transmitted to the load input terminal of the register 407 via the OR gates 413 and 414, and the AND gate 412, allowing the register 407 to sample and hold the input signals S1–S6. Since only the signals S3 and S6 are at the low level, only the transistors 403 and 406 are made unconductive. Accordingly, the spark control signals S#3 and S#4 are outputted to the power transistors 213 and 216 so that the associated cylinders #3 and #4 are exposed to sparks.

In the case where the reference pulse PD is inputted into the control unit 21, the cylinder discrimination circuit within the unit 21 generates the corresponding cylinder discrimination pulse SD as understood from FIG. 6. This cylinder discrimination pulse SD is transmitted to the decoder 408 so that only the output signals S2 and S5 assume the low level as understood from FIG. 8. At the same time, the cylinder discrimination pulse SD is transmitted to the load input terminal of the register 407 via the OR gates 413 and 414, and the AND gate 412, allowing the register 407 to sample and hold the input signals S1–S6. Since only the signals S2 and S5 are at the low level, only the transistors 402 and 405 are made unconductive. Accordingly, the spark control signals S#2 and S#5 are outputted to the power transistors 212 and 215 so that the associated cylinders #2 and #5 are exposed to sparks.

After the above-mentioned initial interval, the first reference pulse PA will be inputted into the control unit 21. When the first reference pulse PA is inputted into the control unit 21, the cylinder discrimination circuit within the unit 21 generates the corresponding cylinder discrimination pulse SA as understood from FIG. 6. This cylinder discrimination pule SA is transmitted to the decoder 408 so that only the output signal S1 assumes the low level as understood from FIG. 8. At the same time, the cylinder discrimination pulse SA is transmitted to the load input terminal of the register 407 via the OR gate 413, allowing the register 407 to sample and hole the input signals S1–S6. Since only the signal S1 is at the low level, only the transistor 401 is made unconductive. Accordingly, the spark control signal S#1 is outputted to the power transistor 211 so that the associated cylinder #1 is exposed to spark. Furthermore, the cylinder discrimination pulse SA sets the flip-flop 410 so that a high level signal is outputted from the flip-flop 410 to the invertor 411. As a result, the invertor 411 outputs a low level signal to the AND gate 412, thereby closing the gate 412. When the AND gate 412 is closed, following cylinder discrimination pulses SB, SC, and SD are prevented from entering the load input terminal of the register 407. Accordingly, after the reference pulse PA is inputted into the control unit 21, the shift register 407 will not sample and hold the signals S1–S6 in response to the cylinder discrimination pulses SB, SC, and SD. In other words, after the reference pulse PA in inputted into the control unit 21, the register 407 operates essentially independent of the cylinder discrimination pulses SB, SC, and SD.

During normal opeation of the engine except for the above-mentioned engine start or cranking, that is, during engine operation after the reference pulse PA is inputted into the control unit 21, when the later reference pulse PA is inputted into the control unit 21, the circuit 21 outputs the spark control signal S#1 to the power transistor 211, causing a spark in the associated cylinder #1. When the reference pulse PD following the reference pulse PA is inputted into the control unit 21, the circuit 21 outputs the spark control signal S#5 to the power transistor 212, causing a spark in the associated cylinder #5. When the reference pulse PC preceding the reference pulse PB is inputted into the control unit 21, the circuit 21 outputs the spark control signal S#3 to the power transistor 213, causing a spark in the associated cylinder #3. When the reference pulse PB is inputted into the control unit 21, the circuit 21 outputs the spark control signal S#6 to the power transistor 214, causing a spark in the associated cylinder #6. When the reference pulse PD following the reference pulse PB is inputted into the control unit 21, the circuit 21 outputs the spark control signal S#2 to the power transistor 215, causing a spark in the associated cylinder #2. When the reference pulse PC preceding the reference pulse PA is inputted into the control unit 21, the circuit 21 outputs the spark control signal S#4 to the power transistor 216, causing a spark in the associated cylinder #4.

Operation during the above-mentioned normal operation of the engine will be described in more detail. In the case where the later reference pulse PA is inputted into the control unit 21, the cylinder discrimination circuit within the unit 21 generates the corresponding cylinder discrimination pulse SA as understood from FIG. 6. This cylinder discrimination pulse SA is transmitted to the decoder 408 so that only the output signal S1 assumes the low level as understood from FIG. 8. At the same time, the cylinder discrimination pulse SA is transmitted to the load input terminal of the register 407 via the OR gate 413, allowing the register 407 to sample and hold the input signals S1–S6. Since only the signal S1 is at the low level, only the transistor 401 is made unconductive. Accordingly, only the spark control signal S#1 is outputted to the power transistor 211 so that the associated cylinder #1 is exposed to spark.

In the case where the other reference pulses PB–PC are inputted into the control unit 21, the cylinder discrimination circuit within the unit 21 generates the cylinder discrimination pulses SB–SD respectively. Since these cylinder discrimination pulses SB–SD are prevented from traveling to the load input terminal of the shift register 407 by the closed AND gate 412 so that the register 407 does not sample the signals S1–S6 and that the register 407 operates independent of these pulses SB–SD. In this case, the register 407 shifts states of its output signals each time the trailing edge of a spark control pulse Sign occurs, that is, each time spark occurs. This state shift of the output signals from the register 407 makes the transistors 402, 403, 404, 405, and 406 unconductive sequentially, thereby outputting the spark control signals S#5, S#3, S#6, S#3, and S#4 in turn. Accordingly, after the cylinder #1 is exposed to spark, the cylinders #5, #3, #6, #2, and #4 are exposed to sparks sequentally.

A modification to the above-mentioned embodiment will be described hereinafter. In this modification, only the internal design of the decoder 408 is changed as follows. As shown in FIG. 10, when the signal SB inputted into the modified decoder 408 is at the high level but the other signals SA, SC, and SD inputted into the modified decoder 408 are at the low level, the signal S4 outputted from the modified decoder 408 assumes the low level but the other signals S1–S3, and S5–S6 outputted from the modified decoder 408 assume the high level. In other cases, the modified decoder 408 operates in the same way as in FIG. 8.

Accordingly, in this modification, as shown in FIG. 11, during the initial interval within engine cranking or start, when the reference pulse PB is inputted into the control unit 21, the circuit 21 outputs only the spark control signal S#6 to the power transistor 214 so that only the cylinder #6 is exposed to spark. In other cases, this modification operates in the same way as in FIG. 9.

What is claimed is:

1. A spark control system for an engine having a crankshaft and cylinders, each of the cylinders being associated with an ignition coil and a power transistor for controlling the ignition coil, the system comprising:

(a) means (21) for generating reference signals at reference crank angles corresponding to the cylinders respectively, wherein the cylinders are separated into groups and the cylinders in a common group are different from each other by an interval or 360° in crank angle, wherein the reference signals corresponding to the cylinders in a common group are similar to each other and the reference signal corresponding to the cylinder in a group is different from the reference signal corresponding to the cylinder in other group, and wherein the reference signal corresponding to preset one of the cylinders is different from the reference signals corresponding to the other cylinders;

(b) means for, during engine start, causing sparks simultaneously in the cylinders in a common group in accordance with the reference signals corresponding to said cylinders in said gorup until the reference signal corresponding to the preset cylinder is generated; and (c) means for, when and after the reference signal corresponding to the preset cylinder is generated, causing a spark in one of the cylinders sequentially in a predetermined orer starting from the preset cylinder.

2. The system of claim 1, wherein the reference signal generating means comprises a signal disc (100) rotatable with rotation of the crankshaft, the signal disc having angularly spaced slits corresponding to the cylinders, the slits corresponding to the cylinders in a common group being similar to each other, the slit corresponding to the cylinder in a group being different from the slit corresponding to the cylinder in other group, the slit corresponding to the preset cylinder being different from the slits corresponding to the other cylinders, and wherein the reference signal generating means further comprises means for optically detecting the slits as the disc rotates.

3. A spark control system for an engine hacng a crankshaft and cylinders, the system comprising:

(a) means for generating reference signals corresponding to the cylinders respectively, wherein the reference signals are separated into groups and the reference signals in a common group are similar to each other, wherein the reference signal in a group differs from the reference signal in other group, and wherein the reference signal corresponding to preset one of the cylinders differs from the reference signals corresponding to the other cylinders;

(b) means for generating sparks simultaneously in the cylinders in a common group in accordance with the reference signals until the first reference signal corresponding to the preset cylinder is generated.

(c) means for generating a spark in the preset cylinder in accordance with the reference signal corresponding to the preset cylinder; and (d) means for generating a spark in one of the cylinders, except for the preset cylinder, sequentially in a predetermined order after the first reference signal corresponding to the preset cylinder is generated.

* * * * *